US009187935B2

(12) United States Patent
Dow

(10) Patent No.: US 9,187,935 B2
(45) Date of Patent: Nov. 17, 2015

(54) LATCH ASSEMBLY

(75) Inventor: Ian J. Dow, Bloomfield, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 700 days.

(21) Appl. No.: 13/341,021

(22) Filed: Dec. 30, 2011

(65) Prior Publication Data

US 2013/0099511 A1 Apr. 25, 2013

Related U.S. Application Data

(63) Continuation-in-part of application No. 13/276,788, filed on Oct. 19, 2011, now abandoned.

(51) Int. Cl.

| | |
|---|---|
| ***E05C 3/16*** | (2006.01) |
| ***E05B 81/14*** | (2014.01) |
| *E05B 15/04* | (2006.01) |

(52) U.S. Cl.
CPC ..... *E05B 81/15* (2013.01); *E05B 2015/0493* (2013.01); *Y10T 292/1059* (2015.04)

(58) Field of Classification Search
CPC ..... E05B 81/14; E05B 81/06
USPC ..... 292/216, 226
See application file for complete search history.

(56) References Cited

U.S. PATENT DOCUMENTS

| | | | | |
|---|---|---|---|---|
| 3,309,127 | A | 3/1967 | Pickles | |
| 4,131,582 | A * | 12/1978 | Kako et al. | 524/457 |
| 4,358,141 | A * | 11/1982 | Hamada | 292/216 |
| 4,601,500 | A * | 7/1986 | Bernard | 292/201 |
| 4,664,430 | A * | 5/1987 | Bernard | 292/201 |
| 4,783,103 | A * | 11/1988 | Schlegel | 292/216 |
| 5,409,273 | A | 4/1995 | Claar et al. | |
| 6,148,651 | A * | 11/2000 | Roncin | 70/264 |
| 6,681,606 | B2 * | 1/2004 | Baukholt | 70/257 |
| 7,261,339 | B2 | 8/2007 | Kiehl | |
| 2011/0012375 | A1 * | 1/2011 | Graute | 292/200 |
| 2011/0012376 | A1 | 1/2011 | Hunt et al. | |
| 2012/0049543 | A1 | 3/2012 | Park | |

* cited by examiner

*Primary Examiner* — Mark Williams
(74) *Attorney, Agent, or Firm* — Cantor Colburn LLP

(57) ABSTRACT

A latch having a fork bolt and a detent lever is provided. The detent lever moves between an engaged position, wherein the detent lever engages the fork bolt and a disengaged position wherein the detent lever is disengaged from the fork bolt. A first spring acts on the detent lever, the first spring has a first biasing position wherein the detent lever is biased into the engaged position and has a second biasing position wherein the detent lever is biased into the disengaged position. The first spring moves between the first biasing position and the second biasing position during unlatching of the latch and the first spring is in the first biasing position during latching of the latch.

11 Claims, 2 Drawing Sheets

LATCH ASSEMBLY

CROSS REFERENCE TO RELATED APPLICATIONS

This application is a continuation in part of U.S. patent application Ser. No. 13/276,788 filed Oct. 19, 2011, the contents of which are incorporated herein by reference thereto.

BACKGROUND OF THE INVENTION

The present invention relates to latch assemblies and, more specifically to a latch assembly having a hold open spring.

Certain passenger vehicles are equipped with a rear vehicle storage compartment, commonly known as a trunk. The trunk is closed by a deck lid that is hinged to the vehicle body and swings open to provide access to the storage compartment. Similarly, other vehicles are equipped with a lift gate that allows access to the rear of the vehicle through a gate that is hinged at or near the roof line of a vehicle and opens upward. Other vehicles have sliding doors that run horizontally on a track between an opened and closed position. Each of the deck lid, lift gate or sliding door can be thought of as panels that allow access to the interior of the vehicle compartment. Compartment latches, enable each of these types of panels to be secured and closed.

When it is desired to open these panels, it is known to use a remote unlatch mechanism that releases a detent lever from engagement with a fork bolt, allowing a striker pin to be removed from the catch (or throat) of the fork bolt. Advantageously, the deck lid, lift gate or sliding door will release from the striker pin and bias away from the striker due to shocks, springs, motors etc. incorporated in these panels. However, when the panel does not bias away, the remote unlatch mechanism that causes the detent lever to be released from engagement with the fork bolt is de-energized. As a result, the detent lever risks falling back into engagement with the fork bolt; and the panel cannot be opened. When the panel does not automatically bias open upon release of the detent lever from the fork bolt, it would be advantageous to maintain the detent lever in a released position until such time as the panel can be manually opened. Normally this is done with multiple additional parts, which adds complexity and cost to a latch.

SUMMARY OF THE INVENTION

The above-discussed and other drawbacks and deficiencies of the prior art are overcome or alleviated by a latch including a fork bolt movable between an open position and a closed position and a detent lever configured to cooperate with the fork bolt. The detent lever moves between an engaged position and a disengaged position. In the engaged position the detent lever engages the fork bolt and in the disengaged position the detent lever is disengaged from the fork bolt. A first spring acts on the detent lever. The first spring has a first biasing position where the detent lever is biased in the engaged position and has a second biasing position where the detent lever is biased in the disengaged position. The first spring moves between the first biasing position and the second biasing position during unlatching of the latch. The first spring is in the first biasing position during latching of the latch. A second spring acts on the fork bolt to urge the fork bolt rotationally towards the open position. The first and second springs cooperate to maintain the fork bolt in the closed position when the latch is latched.

A latch for cooperating with a striker pin is presented. The latch includes a housing with a fork bolt rotationally mounted to the housing. The fork bolt has a throat portion receptive to the striker pin. The fork bolt rotates between an open position and closed position. In the open position the fork bolt is free to move away from or towards the striker pin and in the closed position the fork bolt is secured about the striker pin. A detent lever rotationally mounted to the housing and configured to cooperate with the fork bolt is also included. The detent lever rotates between an engaged position and a disengaged position. In the engaged position the detent lever engages the fork bolt and in the disengaged position the detent lever is disengage from the fork bolt. A first spring is attached at one end thereof to the detent lever and at an other end thereof to the housing. The first spring has a first biasing position where the detent lever is biased in the engaged position and has a second position where the detent lever is biased in the disengaged position. The first spring has a center axis which is in a first position when the first spring is in the first biasing position and in a second biasing position when the first spring is in the second biasing position. The first and second positions are each offset from an axis of rotation of the detent lever. The first spring moves between the first biasing position and the second biasing position during unlatching of the latch. The first spring is in the first biasing position during latching of the latch. A second spring is attached at one end thereof to the fork bolt and at an other end thereof to the housing. The second spring has a center axis which is proximate an axis of rotation of the fork bolt. The second spring urges the fork bolt rotationally towards the open position.

A method of operating a latch is presented. The method includes rotating a fork bolt between an open position and a closed position and moving a detent lever between an engaged position and a disengaged position. The method further includes engaging the detent lever with the fork bolt when the detent lever is in the engaged position and disengaging the detent lever from the fork bolt when the detent lever is in the disengaged position. The method still further includes biasing the detent lever in a first bias position where the detent lever is biased in the engaged position and in a second bias position where the detent lever is biased in the disengaged position. The detent lever is biased in the first bias position and the second bias position during unlatching of the latch. The detent lever is biased in the first bias position during latching of the latch. The method also includes biasing the fork bolt towards the open position.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION

Figure 1:
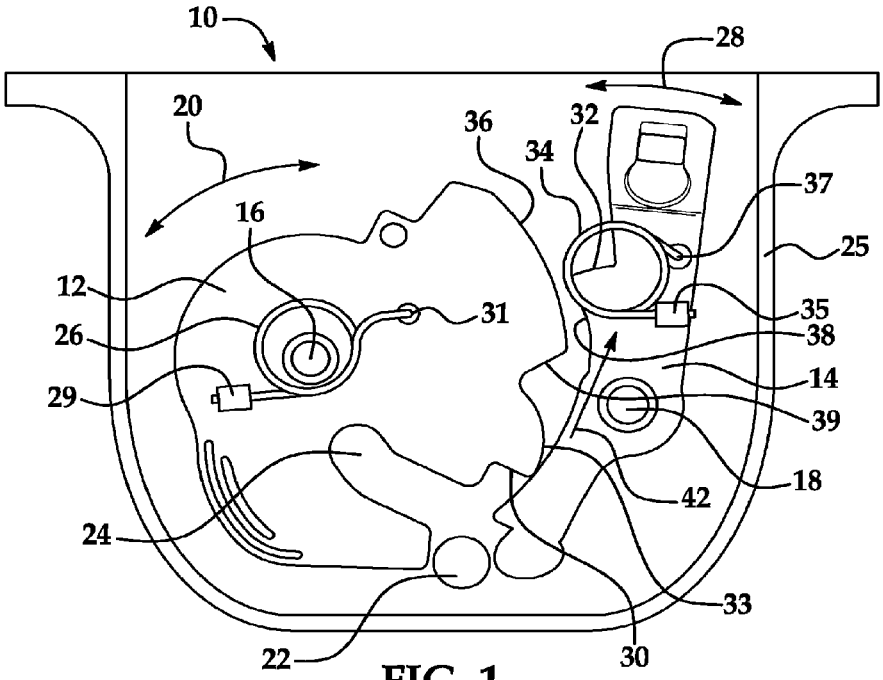
FIG. 1 is an illustration showing the latch in the unlatched position.

Exemplary embodiments of the present invention relate to an apparatus and method for providing a latch assembly. Furthermore, exemplary embodiments are directed to a latch assembly having a fork bolt movably secured thereto for movement between a latched position and an unlatched position. The latch assembly further comprising a detent lever capable of movement between an engaged position and a disengaged position, wherein the detent lever engages the fork bolt in the engaged position and disengages the fork bolt in the disengaged position. The latch assembly further comprises an over center return spring that in a first biasing position loads the detent lever in the engaged position until an actuator moves the detent lever to the disengaged position, where the over center return spring is urged to a second biasing position. The over center spring's load in the second biasing position then holds the detent lever in the disengaged position until the action of the fork bolt returns the detent lever to the engaged position, where the over center return spring is urged back to the first biasing position.

Certain passenger vehicles are equipped with a rear vehicle storage compartment, commonly known as a trunk. The trunk is closed by a deck lid that is hinged to the vehicle body and swings open to provide access to the storage compartment. Similarly, other vehicles are equipped with a lift gate that allows access to the rear of the vehicle through a gate that is hinged at or near the roof line of a vehicle and opens upward. Other vehicles have sliding doors that run horizontally on a track between an opened and closed position. Each of the deck lid, lift gate or sliding door can be thought of as panels that allow access to the interior of the vehicle compartment. Compartment latches, enable each of these types of panels to be secured and closed.

When it is desired to open these panels, it is known to use a remote unlatch mechanism that releases a detent lever from engagement with a fork bolt, allowing a striker pin to be removed from the catch (or throat) of the fork bolt. Advantageously, the deck lid, lift gate or sliding door will release from the striker pin and bias away from the striker pin due to shocks, springs, motors etc. incorporated in these panels. However, when the panel does not bias away, the remote unlatch mechanism that cause the detent lever to be released from engagement with the fork bolt and the panel cannot be opened. When the panel does not automatically bias open upon release of the detent lever from the fork bolt, it would be advantageous to maintain the detent lever in a disengaged position until such time as the panel can be manually opened. Normally this is done with multiple additional parts, which adds complexity and cost to a latch.

Various exemplary embodiments of the present invention allow a detent lever of a latch to stay in a disengaged position. This can be useful when a door or lid that is held closed by the latch is intended to be open, but does not act in the desired fashion due to a circumstance not associated with the latch.

Figure 2:
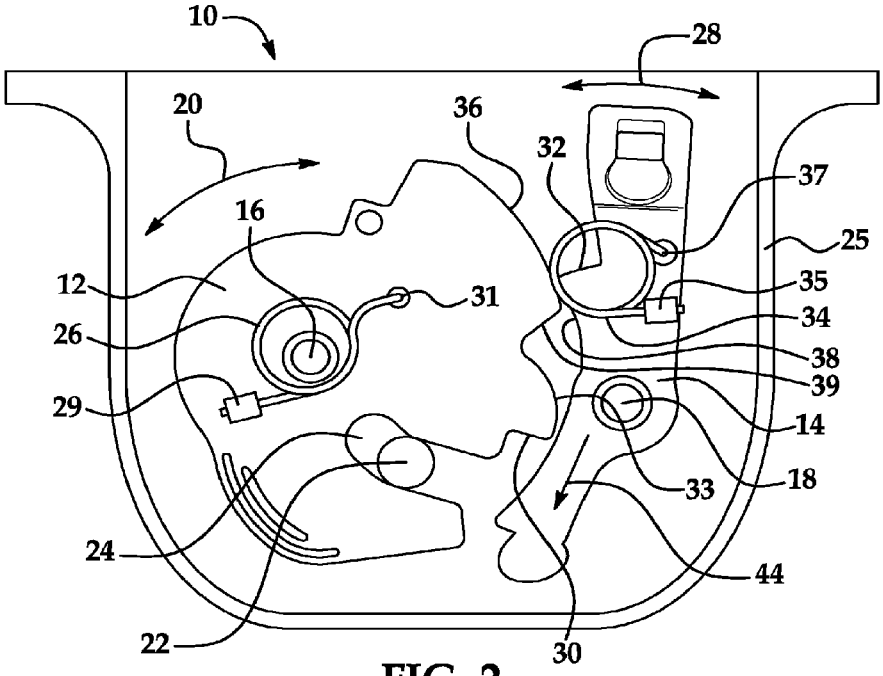
FIG. 2 is an illustration showing the latch during latching.
Figure 3:
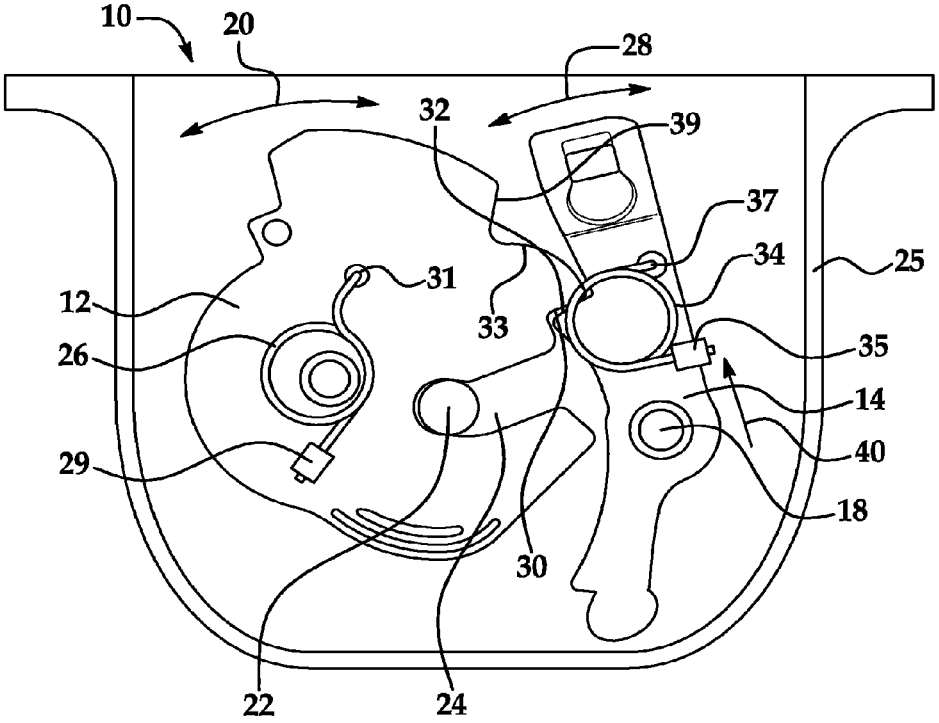
FIG. 3 is an illustration showing the latch in the latched position.

Referring now to the FIGS. embodiments of the invention will be described with reference to specific embodiments, without limiting the same, FIGS. 1-3 shows a latch or latch assembly designated 10, with one cover of the latch removed to facilitate illustrating the inner workings of the latch 10. In the exemplary embodiment shown latch 10 is a compartment latch. A compartment latch 10 of the type shown is useful for the rear compartment such as a trunk of a vehicle. The latch 10 can keep the trunk lid latched, can keep a lift gate vehicle latched or a sliding door vehicle closed, such as a van door. However, the invention is applicable to any environment where the features of the invention are desired. For example, the latch assembly can be secured to a hood, door, window, lift gate, trunk lid, etc. and the striker pin is secured to the vehicle body at an opening into which the hood, door, window, lift gate, trunk lid, etc. is received. Alternatively, the latch assembly can be attached to a vehicle body at an opening that a hood, door, window, lift gate, trunk lid, etc. is received such that the fork bolt is moved between the open position and the closed position when the hood, door, window, lift gate, trunk lid, etc. is opened and closed and the fork bolt engages the striker pin that is secured to the hood, door, window, lift gate, trunk lid, etc.

The latch 10 is located on a first element, such as a trunk lid (not shown), and includes a fork bolt 12 and a detent lever 14 each being pivotally mounted. The fork bolt 12 is capable of rotation about a first stud 16, while the detent lever 14 is capable of rotation about a second stud 18. The fork bolt 12 is capable of movement in the directions indicated by an arrow line 20 between an closed position (shown in FIG. 3) where a striker pin 22 is engaged by a throat 24 of the fork bolt 12 and a mostly open position (shown in FIG. 1) where the striker pin 22 is free to be released from the throat 24 of the fork bolt 12. A housing 25 of the latch 10 also has a complimentary opening (not shown) for the receipt of the striker pin 22 therein when it is engaged by the fork bolt 12. The fork bolt 12 is biased by an over center spring 26 in the open position. The spring 26 is attached at one end 29 to the housing at the other end 31 to the fork bolt 12. While spring 26 is described as an over center spring in this exemplary embodiment, other spring configurations that would bias the fork bolt 12 towards the open position may be employed without departing from the spirit and scope of the invention. The fork bolt 12 is formed from metal (e.g., steel), plastic, or any other suitable material.

The detent lever 14 is pivotally secured to the housing 25 for movement in the directions of an arrow line 28 between an engaged position (shown in FIGS. 2 and 3) where the detent lever 14 engages or interacts with the fork bolt 12 and the disengaged position (shown in FIG. 1) where the detent lever 14 is disengaged or does not interact with the fork bolt 12. The latch 10 is in a latched position when the fork bolt 12 is retained in the closed position by the detent lever 14. Again, the detent lever 14 is in the engaged position when it is interacting with the fork bolt 12. The fork bolt 12 at the side that interacts with the detent lever 14 has the throat 24 that leads to a first shoulder surface 30. Continuing from shoulder surface 30 is a first arcuate surface 33 that ends at second shoulder surface 39. Continuing from the shoulder surface 39 is a second arcuate surface 36. The detent lever 14 at the side that interacts with the fork bolt 12 has an arcuate surface 38 that leads to a shoulder surface 32. The detent lever 14 is biased by an over center spring 34 that has first and second biasing positions. By first and second biasing positions it is meant that the detent lever 14 will have two at rest positions from which the spring 34 will bias rotation of the detent lever 14 from. This is in contrast to the spring 26 which only has a single biasing position. In other words, the spring 34 has a center axis which is in a first position when the spring 34 is in the first biasing position and in a second position when the spring 34 is in the second biasing position. The first and second positions are each offset from each other and both from an axis of rotation of the detent lever 14. The spring 26 has a center axis which is proximate an axis of rotation of the fork bolt 12.

The spring 34 in the first biasing position (FIGS. 2 and 3) biases the detent lever 14 for engagement with the fork bolt 12, i.e., the engaged position. The spring 34 in the second biasing position (FIG. 1) biases the detent lever 14 for disengagement of the with the fork bolt 12, i.e., the disengaged position. The spring 34 is attached at one end 35 to the housing at the other end 37 to the detent lever 14. While spring 34 is described as an over center spring in this exemplary embodiment, other spring configurations that would provide multiple biasing positions to bias the detent lever 14 towards the engaged and disengaged positions as described above, may be employed without departing from the spirit and scope of the invention. The spring 34 having two biasing positions is an important feature of the invention. The detent level 14 is formed from metal (e.g., steel), plastic, or any other suitable material. In order to move the detent lever 14 to the disengaged position when it is in the engaged position a release mechanism (not shown) coupled to the detent lever 14 is configured to move the detent lever 14 from the engaged position to the disengaged position upon actuation of the release mechanism.

Referring to FIGS. 1 and 3, during unlatching the latch 10 is moved from the latched position to the unlatched position. The detent lever 14 is maintained in the engaged position, as the spring 34 is in the first biasing position, with a resulting force in the direction of arrow 40 (FIG. 3), which causes shoulder surface 30 of the fork bolt 12 to contact the shoulder surface 32 of the detent lever 14. During unlatching of the latch 10, rotation of the detent lever 14 is initiated in a clockwise rotation by action of the release mechanism. The release mechanism is set into action manually by an operator or by an automatic lock-unlock mechanism, such being well known. This action of the release mechanism rotates the detent lever 14 in a clockwise direction, which causes the shoulder surface 32 to push against the shoulder surface 30, and thereby slightly rotating the fork bolt 12 in a counter clockwise direction against rotational spring forces of the spring 26 until the shoulder surface 32 no longer contacts the shoulder surface 30. The fork bolt 12 will then rotate back. At this point the release mechanism no longer acts on the detent lever 14 and the detent lever 14 continues to rotate in response to the spring 34 being urged to the second biasing position where the detent lever 14 no longer acts on the fork bolt 12, i.e., the disengaged position of the detent lever 14, discussed above. The detent lever 14 is maintained in the disengaged position, as the spring 34 is in the second biasing position, with a resulting force in the direction of arrow 42 (FIG. 1). The fork bolt 12 continues to rotate in a clockwise direction from the closed position towards the open position under the rotational spring forces of the spring 26. The detent lever 14 is in the disengaged position, and is maintained there by the spring forces of the spring 34 in the second biasing position. The arcuate surface 33 of the fork bolt 12 then contacts the arcuate surface 38 of the detent lever 14 as the fork bolt 12 continues to rotate. This contact rotates the detent lever 14 counterclockwise causing the spring 34 to return to the first biasing position. The rotation of the fork bolt 12 also urges the throat 24 of the fork bolt 12 against the striker pin 22. The fork bolt 12 continues to rotate about the striker pin 22 to the open position, as the panel moves away from the compartment. As the fork bolt 12 continues to rotate so does the detent lever 14, with the arcuate surface 36 of the fork bolt 12 contacting the arcuate surface 38 of the detent lever 14, until the rotation ceases. At which point the fork bolt 12 is clear of the striker pin 22, and the panel can continue to move away from the compartment.

Referring again to FIGS. 1-3, during latching the latch 10 is moved from the unlatched position to the latched position. The detent lever 14 is in the engaged position, as the spring 34 is in the first biasing position, with the arcuate surface 36 of the fork bolt 12 contacting the arcuate surface 38 of the detent lever 14. During latching of the latch 10, rotation of the fork bolt 12 is initiated in a counterclockwise direction when the striker pin 22 is engaged. More specifically, as the panel is moved towards the compartment the striker pin 22 is received in the throat 24 of the fork bolt 12. The striker pin 22 contacts the throat 24 urging the fork bolt 12 to rotate about the striker pin 22. The fork bolt 12 continues to rotate about the striker pin 22 to the closed position, as the panel is moved toward the compartment. As the fork bolt 12 continues to rotate the arcuate surface 36 of the fork bolt 12 is in contact with the arcuate surface 38 of the detent lever 14 causing the detent lever 14 to rotate in a clockwise direction. The spring 34 is in the first biasing position with a resulting force in the direction of arrow 44, which will continue rotation until the shoulder surface 32 of the detent lever 14 and the shoulder surface 30 of the fork bolt 12 abut. At this point the fork bolt 12 secures the striker pin 22, and the latch 10 is in the latched position. In the event that the rotation caused by the interaction of the striker pin 22 and the fork bolt 12 is not sufficient to fully latch the latch 10, as described above, the shoulder surface 32 of the detent lever 14 will catch the shoulder surface 39 of the fork bolt 12. This is a partially latched position from which the latch 10 can be fully latched or unlatched, as is known.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A latch comprising:

a fork bolt movable between an open position, wherein a striker is released by the latch and a closed position, wherein the striker is secured by the latch;

a detent lever configured to cooperate with the fork bolt, the detent lever movable between an engaged position and a disengaged position, in the engaged position the detent lever engages the fork bolt and prevents the fork bolt from moving from the closed position towards the open position, when the detent lever is in the disengaged position the detent lever is disengaged from the fork bolt and the fork bolt can move from the closed position towards the open position;

a first spring acting on the detent lever, the first spring having a first biasing position where the detent lever is biased by the first spring in a first direction towards the engaged position and the first spring having a second biasing position wherein the detent lever is biased by the first spring in a second direction towards the disengaged position, the first spring moving between the first biasing position and the second biasing position during latching and unlatching of the latch, wherein the first biasing position is different from the second biasing position and wherein the first direction is different from the second direction; and a second spring acting on the fork bolt to urge the fork bolt rotationally towards the open position, the first and second springs cooperating to maintain the fork bolt in the closed position when the latch is latched.

2. The latch of claim 1, wherein the first spring is a torsion spring.

3. The latch of claim 2, wherein the first spring has a center axis which is in a first position when the first spring is in the first biasing position and in a second position when the first spring is in the second biasing position, the first and second positions are each offset from an axis of rotation of the detent lever.

4. The latch of claim 1, wherein the second spring is a torsion spring.

5. The latch of claim 4, wherein the second spring has a center axis which is proximate an axis of rotation of the fork bolt.

6. The latch of claim 1, wherein the first and second springs are torsion springs.

7. The latch of claim 6, wherein:

the first spring has a center axis which is in a first position when the first spring is in the first biasing position and in a second position when the first spring is in the second biasing position, the first and second positions are each offset from an axis of rotation of the detent lever; and the second spring has a center axis which is proximate an axis of rotation of the fork bolt.

8. The latch of claim 1, wherein the fork bolt has a first arcuate surface and the detent lever has a second arcuate surface, the second arcuate surface configured to cooperate with first arcuate surface to urge the detent lever towards the engaged position as the fork bolt moves towards the closed position.

9. A latch for cooperating with a striker pin, the latch comprising:

a housing:

a fork bolt rotationally mounted to the housing, the fork bolt having a throat portion receptive to the striker pin, the fork bolt being rotatable between an open position and closed position, in the open position the fork bolt the striker pin is released from the latch and in the closed position the fork bolt secures the striker pin to the latch;

a detent lever rotationally mounted to the housing and configured to cooperate with the fork bolt, the detent lever being rotatable between an engaged position and a disengaged position, in the engaged position the detent lever engages the fork bolt and prevents the fork bolt from moving to the open position from the closed position and when the detent lever is in the disengaged position, the detent lever is disengaged from the fork bolt and the fork bolt can move from the closed position towards the open position;

a first spring attached at one end thereof to the detent lever and at an other end thereof to the housing, the first spring having a first biasing position where the detent lever is biased by the first spring in a first direction towards the engaged position and the first spring having a second position where the detent lever is biased by the first spring in a second direction towards the disengaged position, the first spring having a center axis which is in a first position when the first spring is in the first biasing position and in a second biasing position when the first spring is in the second biasing position, the first and second positions are each offset from an axis of rotation of the detent lever, the first spring moving between the first biasing position and the second biasing position during unlatching of the latch, the first spring is in the first biasing position during latching of the latch, wherein the first biasing position and the second biasing position are different from each other and the first direction and the second direction are different from each other; and a second spring attached at one end thereof to the fork bolt and at an other end thereof to the housing, the second spring has a center axis which is proximate an axis of rotation of the fork bolt, the second spring urging the fork bolt rotationally towards the open position.

10. The latch of claim 9, wherein the first spring is a torsion spring.

11. The latch of claim 9, wherein the second spring is a torsion spring.

* * * * *